US005579009A

United States Patent [19]

Nilsson-Almqvist et al.

[11] Patent Number: 5,579,009

[45] Date of Patent: Nov. 26, 1996

[54] SENSOR SYSTEM

[75] Inventors: Bo Nilsson-Almqvist; Björn Nilsson, both of Karlskoga, Sweden

[73] Assignee: Bofors AB, Karlskoga, Sweden

[21] Appl. No.: 310,406

[22] Filed: Sep. 22, 1994

[30] Foreign Application Priority Data

Sep. 22, 1993 [SE] Sweden ..... 9303081

[51] Int. Cl.[6] ..... G01S 13/58; G01S 13/72; G01S 13/86

[52] U.S. Cl. ..... 342/55; 342/56; 342/59; 342/53

[58] Field of Search ..... 342/54, 55, 56, 342/57, 58, 59, 53

[56] References Cited

U.S. PATENT DOCUMENTS 5,365,236 11/1994 Fagarasan et al. ..... 342/53

FOREIGN PATENT DOCUMENTS 2231219 11/1990 United Kingdom .

*Primary Examiner*—John B. Sotomayor
*Attorney, Agent, or Firm*—Pollock, Vande Sande & Priddy

[57] ABSTRACT

A sensor system comprises a plurality of sensor stations of the same type for surveillance of an area intended to include an object to be protected, the sensor stations being distributed essentially along the periphery of a circle, in the central part of which an object to be protected is intended to be contained. Each sensor station includes a detector unit which is arranged to scan an arc in an azimuth sector of the circle allocated to it up towards the background of the sky in each of two detection fields formed along the arc having different elevation angles with respect to the detector unit. The time of the passage of a target between the two detection fields is measured, and the target position is calculated relative to the sensor station on the basis of the measured time, the speed of the target, the angle between the detection fields and the angle to the target.

12 Claims, 5 Drawing Sheets

SENSOR SYSTEM

FIELD OF THE INVENTION

The present invention relates to a sensor system comprising a plurality of sensor stations for monitoring an area intended to include an object to be protected.

BACKGROUND ART

The increased use of so-called "stand-off" weapons today, and presumably in the future increases the requirement for the ability to detect small targets at a low altitude. By "stand-off" weapons are meant in this connection weapons which can be fired at a short distance outside the range of the anti-aircraft defense and which autonomously steer themselves to the target. These weapons are increasingly utilize the existing terrain protection. The main problem for the anti-aircraft defense is to discover these weapons in time so that effective countermeasures can be taken.

In current reconnaissance technology, on the one hand radar scanners and on the other hand IR scanners are used. The weak points of these scanners have long been known. With respect to radar scanners, problems caused by radar shadows, terrain obstacles and ground clutter can be mentioned. Terrain obstacles, low IR signature in the forward sector of approaching missiles, low contrast and false targets from ground objects constitute problems with IR scanners. To cover a greater surveillance area, information from a plurality of surveillance areas of scanners can be collected together in a common center.

SUMMARY OF THE INVENTION

The object of the present invention is to produce a sensor system which is better capable of discovering low-flying objects in time than today's systems. The object of the invention is achieved by means of a sensor system characterized in that the sensor stations are distributed essentially along the periphery of a circle in the central part of which an object to be protected is intended to be contained. Each sensor station comprises a detector unit which is arranged to scan the arc in an azimuth sector, allocated to it, up towards the background of the sky in two detection fields. The time of the passage of a target between the detection fields is measured in each sensor station and the target position relative to the sensor station is calculated on the basis of the measured time, speed of the target, angle between the detection fields and angle to the target. The individual sensor stations included in the sensor system scan from below and up towards the background of the sky. This avoids interference from the surrounding terrain at the same time as the IR area of a target increases in comparison with the front sector of the target. By utilizing detection fields in each sensor station and measuring the time taken by a target to pass from the first detection field to the second, it is achieved that a target can be detected by relatively simple means and that the target position can be determined with good accuracy.

The position of a sensor station can be determined in the grouping of the sensor station and stored in a memory unit included in the sensor station. According to another embodiment, the position can be determined by means of a radio navigation system included in the sensor station, such as GPS. Knowing the position of the sensor station and the position of a target relative to the sensor station, a close-range protection weapon provided for the object to be protected can be given an unambiguous assignment of the target position.

A target position is suitably assigned by means of three orthogonal coordinate values related to a coordinate system common to the sensor system as soon as it has passed the two detection fields. Quick coarse assignment to a close-range protection weapon can be carried out by sector indication as soon as the first detection field is passed. The target position is preferably indicated as belonging to a circle sector of 360°/n, where n equals the number of sensor stations included. In a preferred embodiment with four sensor stations, this coarse assignment occurs in 90° sectors.

The target speed is advantageously determined by means of speed measuring elements in the form of speed measuring radar arranged in the sensor stations. By utilizing speed measuring radar, a value of the target speed is obtained with great accuracy. In applications with moderate requirements for the accuracy of the speed value, an expected speed of the target on the basis of knowledge of the speed interval within which the target in question is moving can be used as an alternative to measuring.

For scanning the atmosphere, detector units of the sensor stations can comprise a line camera according to a further advantageous embodiment.

The invention will be described in greater detail below with reference to the attached drawings, in which:

BRIEF DESCRIPTIONS OF THE DRAWINGS

DETAILED DESCRIPTION OF THE PREFERRED EMBODIMENTS

Figure 1:
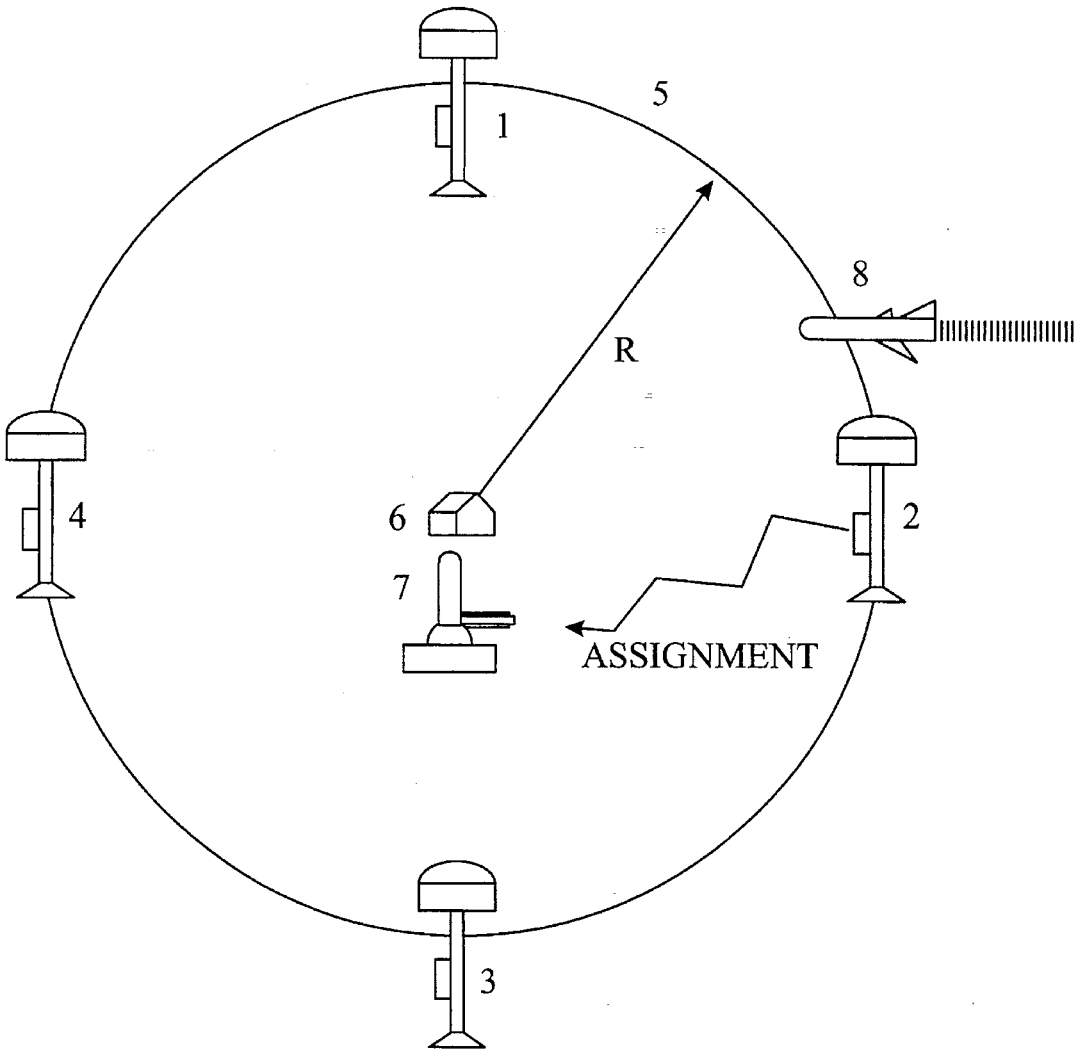
FIG. 1 shows a diagrammatic overview of a sensor system

According to the diagrammatic view of the sensor system shown in FIG. 1, four sensor stations 1–4 are included. The stations are suitably of the IR type. The sensor stations are distributed in the terrain essentially along the periphery of a circle 5. In the center of the circle 5, the object 6 is located which is the object to be protected. In the vicinity of the object 6, the close-range protection weapons 7 are also located which will protect the object 6. A target which is approaching the sensor system has been designated by 8 and can consist of, for example, a low-flying cruise missile.

The four IR sensor stations 1–4 scan the sky in a band above the sensors. When a target 8 with IR signature passes over the area where the sensor system is placed, this is detected by means of two consecutive measurements which are slightly different in elevation angle. On the basis of the two measurements, the target position and altitude can be calculated as described below. It can be observed here that the position of a target can already be coarsely assigned on its first detection. The sensor system to create a "tripwire" over which an object, even a terrain-following object, will not be able to slip away without being discovered. As soon as the target position has been calculated, close-range protection weapons 7 are assigned in three coordinates for fighting the target 8.

With the current threat picture, terrain-following missiles having speeds around 200 m/s, a "tripwire" or circle 5 with a radius R of approximately 2 km should be adequate. Should higher speeds come to the fore, the radius R and the number of sensor stations included can be increased.

With regard to FIGS. 1–4, it will be shown below how the position of a target is determined and allocated to the close-range protection weapons 7.

Figure 2:
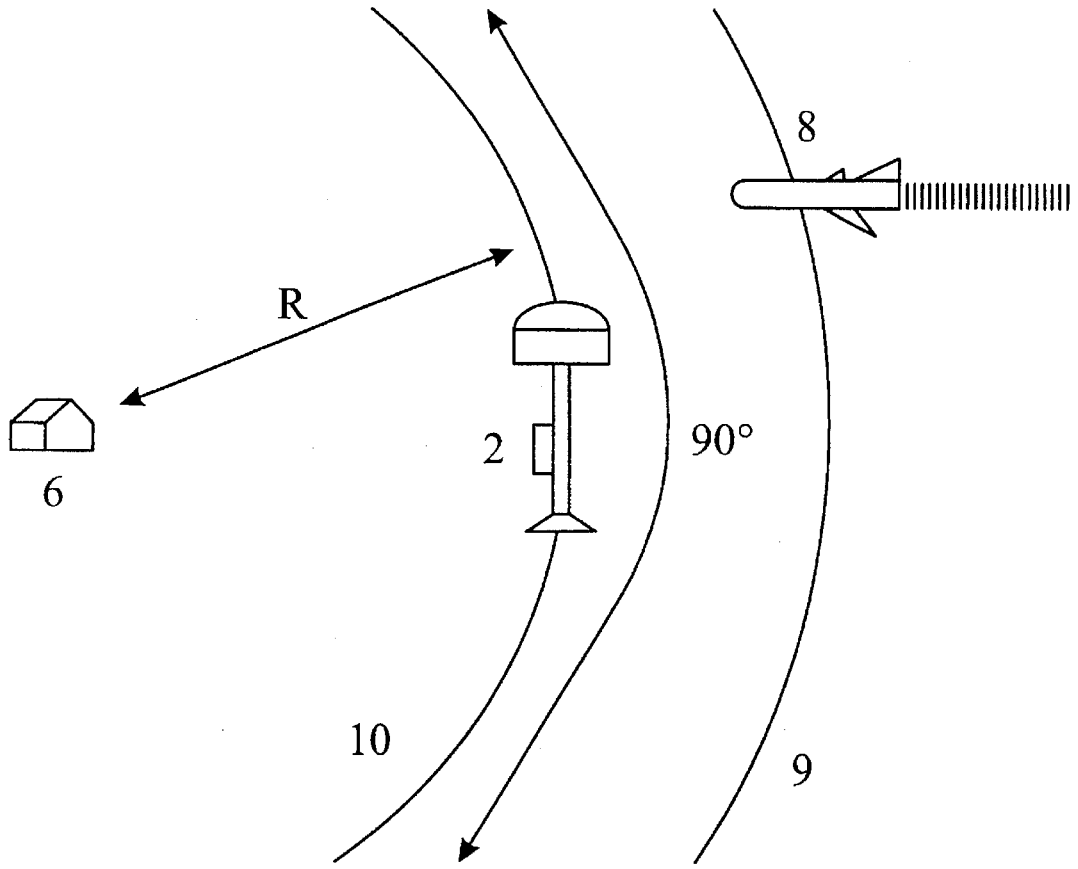
FIG. 2 shows an overview of the two detection fields associated with a sensor station.
Figure 3:
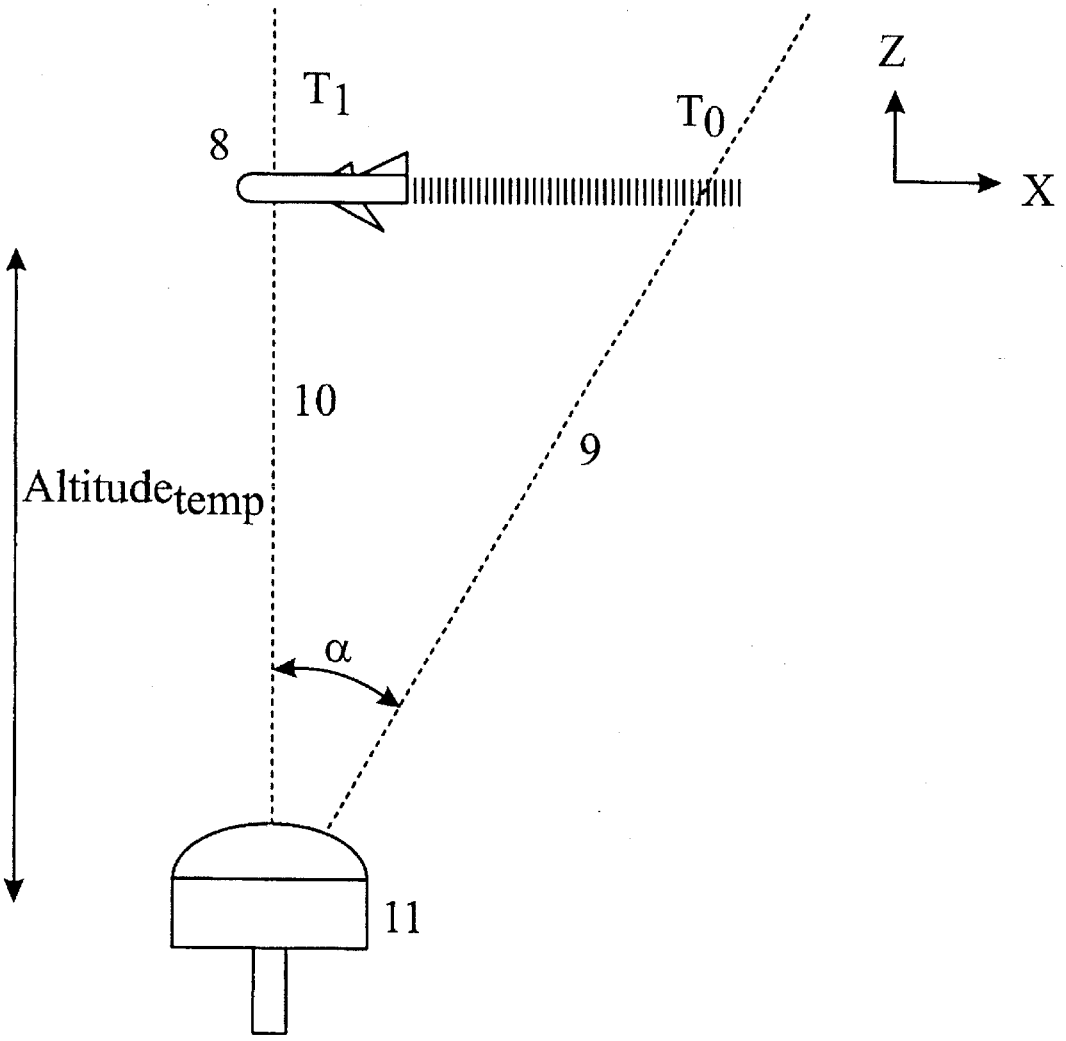
FIG. 3 shows the passage of a missile between the two detection fields of a sensor station, with associated measuring times.

As can be seen from FIGS. 2 and 3, an IR sensor station 1–4 scans the space in a first and a second detection field 9,10. The angle between the two detection fields has been given the designation α and is known. At time $T_0$, the target 8 passes the first detection field 9 and at time $T_1$ it passes the second detection field 10. The time of target passage T between the detection fields is given by the expression:

$$T=T_1-T_0$$

When the time of passage is known by measurement and the angle α between the detection fields 9,10 is known, the slant range of the target passage $\text{Altitude}_{temp}$, see FIG. 3, can be calculated under the assumption that the target speed $V_{missile}$ can be estimated or measured. A speed measuring radar can be used for measuring the speed. The following relationship can be set up:

$$\text{Altitude}_{temp}=(T*V_{missile})/\tan(\alpha)$$

Figure 4:
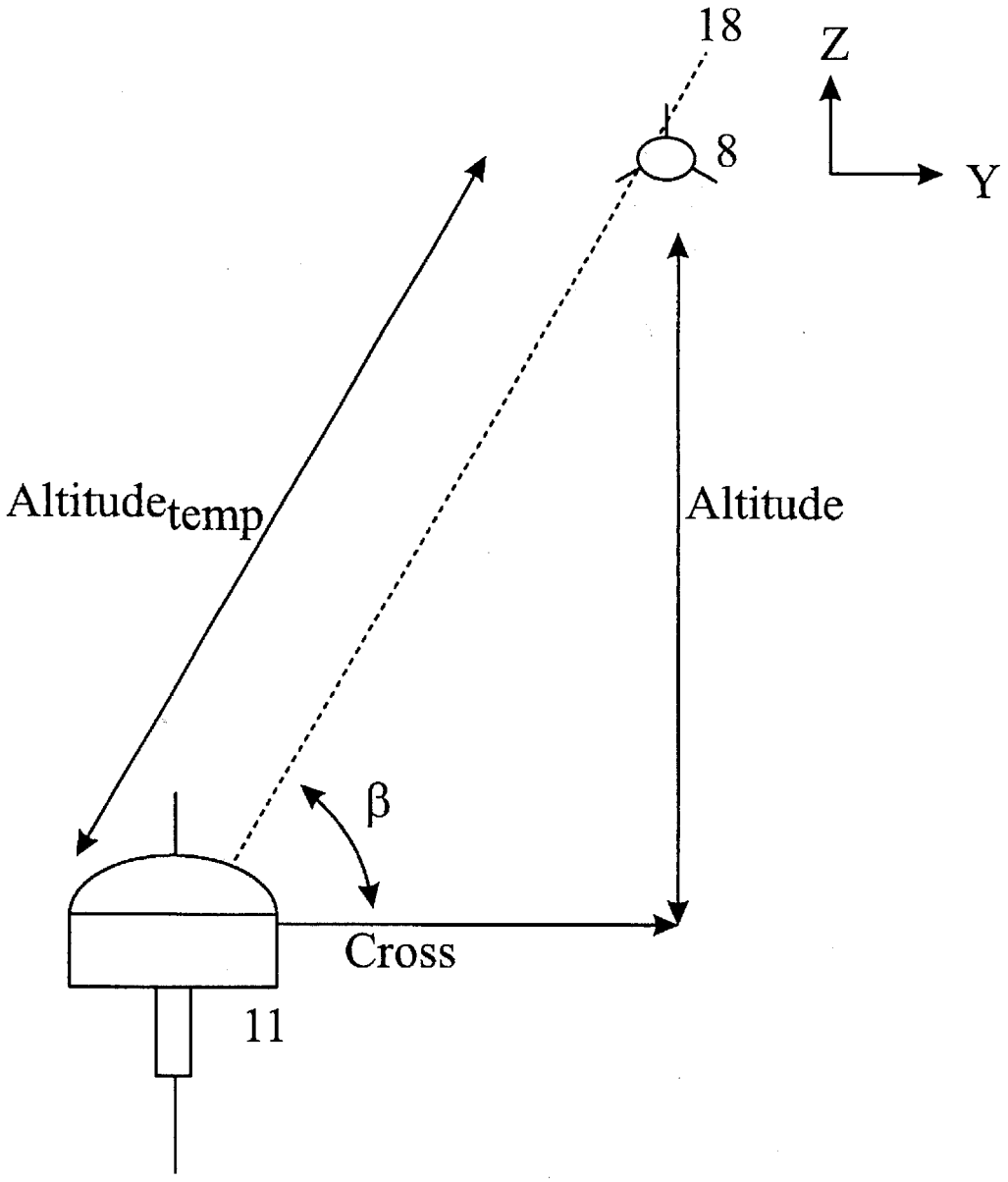
FIG. 4 shows how flying altitude and cross-range can be calculated.

On the basis of the slant range of the target passage and the angle β to the direction of detection 18 according to FIG. 4 in which the detection occurred, the flying altitude "Altitude" of the target and the cross-range "Cross" relative to the sensor station can be calculated according to the following:

$$\text{Altitude}=\text{Altitude}_{temp}*\sin(\beta)$$

$$\text{Cross}=\text{Altitude}_{temp}*\cos(\beta)$$

The cross-range which is calculated lies along the bent detection field of the sensor station which is why the range must be converted to a Cartesian distance relative to the sensor station. The target position relative to the sensor station can now be calculated according to the following:

$$\text{Target}_x=R*\sin(\text{Cross}/R)$$

$$\text{Target}_y=-R*\cos(\text{Cross}/R)$$

$$\text{Target}_z=\text{Altitude}$$

Assignment of target to the close-range protection weapons is obtained on the basis of the position of the sensor station and calculated target position according to the following relationship:

$$\text{Assignment}_x=\text{Sensorpos}_x+\text{target}_x$$

$$\text{Assignment}_y=\text{Sensorpos}_y+\text{target}_y$$

$$\text{Assignment}_z=\text{Sensorpos}_z+\text{target}_z$$

The sensor positions are obtained from a storage medium in which the position of the sensor station is stored after the position has been measured within the grouping of the sensor station.

Figure 5:
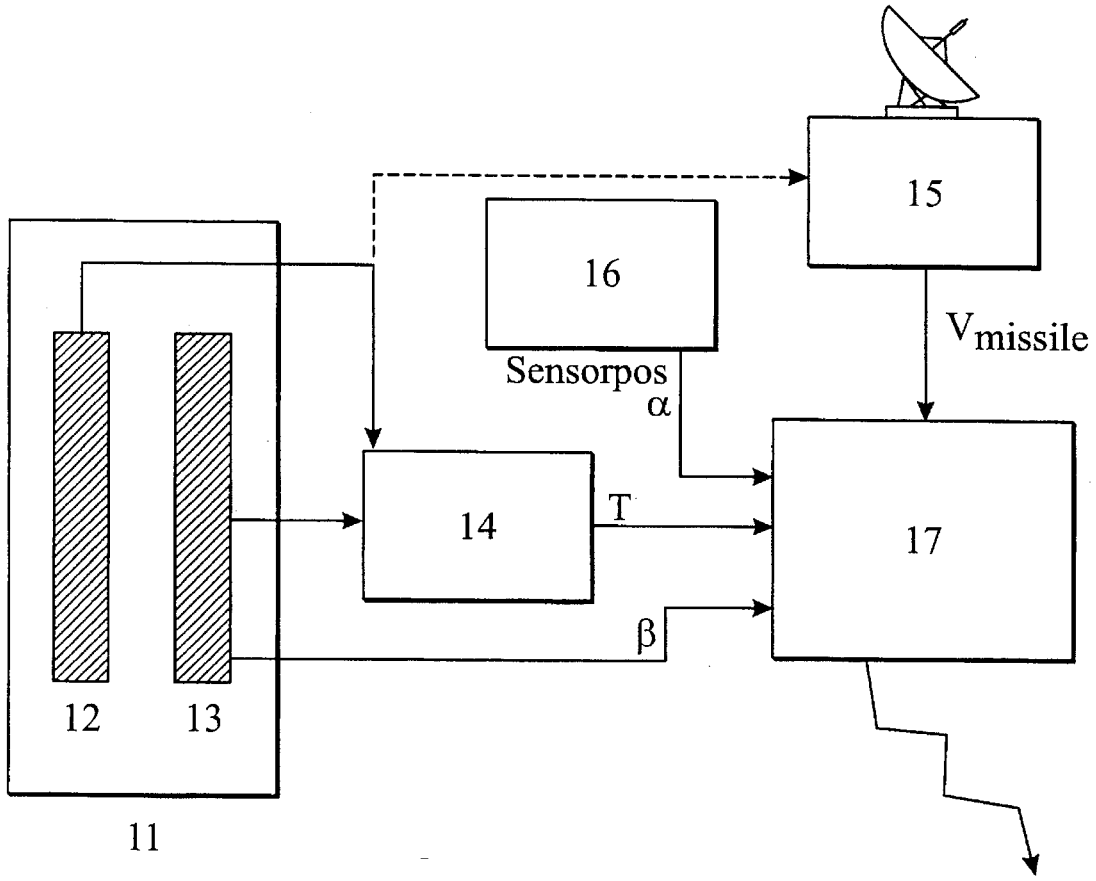
FIG. 5 shows a block diagram of a sensor station included in the sensor system according to the invention.

FIG. 5 shows an example, in a block diagram form, of how a sensor station can be configured.

A detector unit 11 is arranged to operate in an azimuth sector of 90 degrees along the arc of the circle 5. With a circle having a radius of 2 kilometers, this implies that the greatest distance at which a detector unit can see a target is 1571 m. Each detector unit scans the atmosphere 180° above along the arc on its quadrant. The detector unit operates in two different detection fields 9,10 each of which feeds its detector array 12,13. A line camera operating close to the infrared range is advantageously used in the detector unit. In comparison with a scanning camera, the line camera exhibits the advantage of maintaining continuous surveillance. At the short detection ranges in question a good probability of discovery is also obtained against targets which are only aerodynamically heated. If a line camera with 1024 picture elements is used, a resolution of 180°/1024 pixels, that is 0.18°/pixel is obtained. This implies that a pixel corresponds to 4.9 m with a radius of 2 km at the greatest distance.

The detector unit 11 waits for a signal from the detection field 9 which is located outside the circle 5 or "tripwire" which corresponds to the detection field 10. When a target is detected in the detection field 9, a timer 14 is started. The timer is stopped when the target passes the detection field 10. This measures the time of passage T of the target. At the same time as a target is detected in the detection field 9, a speed measuring radar 15 is started which measures the speed of the target $V_{missile}$. A memory-unit 16 stores the position of the sensor station, which is previous measured in the grouping of the sensor station. The memory unit can also store the value of the angle α between the detection fields 9,10. On the basis of the information which is provided by the detector unit 11, the timer 14, the radar 15 and the memory unit 16, a calculating circuit 17 can calculate the target position in correspondence with the relation shown earlier. After the calculations have been carried out, protection weapons are assigned to a target position x, y, z with very high accuracy.

We claim:

1. A sensor system comprising:

a plurality of sensor stations of the same type for surveillance of an area intended to include an object to be protected, said sensor stations being spaced apart essentially along the periphery of a circle, each for surveillance of a segment of the periphery of said circle, in the central part of which an object to be protected is intended to be contained, each sensor station including:

a detector unit which is arranged to scan an arc in an azimuth sector of said circle allocated to it up towards the background of the sky in each of two detection fields formed along the arc having different elevation angles with respect to said detector unit;

measuring means for measuring the time of the passage of a target between the two detection fields; and means for calculating the target position relative to the sensor station on the basis of the measured time, the speed of the target, the angle between the detection fields and the angle to the target.

2. A sensor system according to claim 1 wherein there are at least four sensor stations.

3. A sensor system according to claim 1, wherein said sensor stations include speed measuring elements.

4. A sensor system according to claim 3 wherein said speed measuring elements are speed measuring radars.

5. A sensor system according to claim 1 wherein the detector units of the sensor stations comprise a line camera.

6. A sensor system according to claim 1 wherein the position of a sensor station is determined in the grouping of the sensor stations and is stored in a memory unit included in the sensor station.

7. A sensor system according to claim 1 wherein the position of a sensor station is determined by means of a radio navigation system such as GPS included in the sensor station.

8. A sensor system according to claim 1 wherein the target position, when the target has passed the two detection fields, is assigned three orthogonal coordinate values related to a coordinate system common to the sensor system.

9. A sensor system according to claim 1 wherein said each sensor station incudes means for calculating the speed of the target by determining a time interval between said two detection fields and dividing said time interval into a spatial interval of said two detection fields.

10. A method of surveillance of an area intended to include an object to be protected, including the steps of:

a) positioning a plurality of sensor stations of the same type along the periphery of a circle, said sensor stations being spaced apart, each for surveillance of a segment of the periphery of said circle, in the center part of which an object to be protected is intended to be contained;

b) arranging a detector unit in each sensor station for scanning an arc in an azimuth sector allocated to it up towards the background of the sky in two detection fields formed with respect to said detector unit along the arc having different elevation angles;

c) measuring in each sensor station the time of the passage of a target between the two detection fields; and d) calculating the target position relative to the sensor station on the basis of the measured time, the speed of the target, the angle between the detection fields and the angle to the target.

11. A method according to claim 10 further including measuring the speed of the target detected by said detector unit with a radar.

12. A method according to claim 10 further including storing of the data including previously measured position of the sensor station in the grouping of the sensor station and on the value of the angle between the detection fields.

* * * * *